US005706691A

United States Patent [19]

Okamoto et al.

[11] Patent Number: 5,706,691

[45] Date of Patent: Jan. 13, 1998

[54] STAND SUPPORTING METHOD AND EQUIPMENT THEREOF AND A POSITION MEASURING METHOD OF A SUPPORTING PLATFORM AND EQUIPMENT THEREOF FOR ROLL FORMER

[75] Inventors: Atumu Okamoto, Kawanishi; James Mok, Itami, both of Japan

[73] Assignee: Nakata Manufacturing Co., Ltd., Osaka, Japan

[21] Appl. No.: 564,274

[22] PCT Filed: Apr. 8, 1994

[86] PCT No.: PCT/JP94/00597

§ 371 Date: Mar. 29, 1996

§ 102(e) Date: Mar. 29, 1996

[87] PCT Pub. No.: WO95/01848

PCT Pub. Date: Jan. 19, 1995

[30] Foreign Application Priority Data

Jul. 8, 1993 [JP] Japan ..... 5-194245

[51] Int. Cl.[6] ..... B21B 31/00

[52] U.S. Cl. ..... 72/237; 72/245; 72/247; 72/239; 72/20.1

[58] Field of Search ..... 72/237, 238, 239, 72/245, 246, 247, 20.1, 210; 414/589, 590, 917; 248/183, 184, 653, 654, 163.1, 180.1, 181.2, 183.1, 184.1; 901/16, 28, 29, 34, 41

[56] References Cited

U.S. PATENT DOCUMENTS

| | | | |
|---|---|---|---|
| 5,053,687 | 10/1991 | Merlet | 901/28 |
| 5,114,300 | 5/1992 | Shahinpoor | 901/29 |
| 5,179,525 | 1/1993 | Griffis et al. | 248/163.1 |
| 5,301,566 | 4/1994 | Tahmasebi et al. | 901/16 |
| 5,401,128 | 3/1995 | Lindem et al. | 409/132 |
| 5,451,134 | 9/1995 | Bryfogle | 248/653 |
| 5,460,474 | 10/1995 | Iles | 414/590 |
| 5,489,168 | 2/1996 | Sheldon et al. | 248/654 |
| 5,538,373 | 7/1996 | Kirkhan | 248/654 |
| 5,575,597 | 11/1996 | Bailey et al. | 901/29 |

*Primary Examiner*—Lowell A. Larson
*Assistant Examiner*—Ed Tolan
*Attorney, Agent, or Firm*—Nikaido, Marmelstein, Murray & Oram LLP

[57] ABSTRACT

It is an object of the present invention to provide a supporting method, equipment, and controlling method for the roll-former stand by which the height and inclined angle of the cluster roll comprising subsequentially deposited plurality of side rolls likely as a roll former as a pipe mill can be arbitrarily set, and the interdistance between said rolls can be reduced. The basic structure consists of the following procedures; namely, (1) a supporting a pair of cluster platforms, on which a common bed is mounted, by a link being formed by jacks; a plurality of side rolls is supported by a roll bracket and deposited on said common bed, (2) fixing both end portions of the link on the platform or a bed plane surface to form an arbitrary triangle, and (3) measuring the length of the link by a linear encoder which is provided along said links. The measured data is converted to the Cartesian coordinates by the computer. Being based on the thus converted measured data, the information of the current positions and the target positions are comparison-computed to change the lengths of each link. By adjusting the lengths of the expanding and/or contracting movement of the links, the links can be freely adjusted either upper or lower (vertical) direction, left or right (horizontal) direction as well as the contact (rotational) direction with the workpiece with respect to the workpiece flow direction.

11 Claims, 8 Drawing Sheets

STAND SUPPORTING METHOD AND EQUIPMENT THEREOF AND A POSITION MEASURING METHOD OF A SUPPORTING PLATFORM AND EQUIPMENT THEREOF FOR ROLL FORMER

TECHNICAL FIELD

The present invention relates to a supporting method and equipment with which a position control of a cluster roll can be easily achieved; said cluster portion is composed of a plurality of side rolls being sequentially placed at a roll former. The present invention furthermore relates to a position measuring method and equipment for a platform of the cluster roll. More particularly, this invention relates to a supporting method for the roll former stands with which the distance between each roll along a moving direction of roll-formed pipes can be minimized by such means that a platform on which a roll bracket is deposited is commonly utilized, a pair of said platform is supported by a jack or the like, and the jack length is controlled, so that the height and inclined angle of said platform can arbitrarily be changed. Moreover, this invention directly relates to a position measuring method for the platform and an equipment thereof with which the length of plurality of jacks that is employed for the platform, is measured, and 6-axis coordinates of said platform are measured and controlled.

BACKGROUND OF THE INVENTION

According to a typical example for a pipe forming by employing a roll forming method, firstly a series of forming rolls is arranged and aligned; said forming roll should correspond to the final dimensions of the pipe diameter as well as the wall thickness, so that the flat strip steel as a starting material can be continuously roll-formed into pipes. This type of the roll-former is known as a continuous roll former. At the final stage of the above mentioned continuous roll-former, both side-edge portions of roll-formed pipes will be welded together to manufacture direct seam-welded pipe, which is sometimes referred to as electric-resistance welded pipes.

The generally operated piping process by the continuous roll-forming method is consisted of the following sequential processes; they include (1) initially roll-forming both side-edge portions of strip steel to form a semi-circular form with breakdown rolls, (2) forming said semi-circular workpieces into approximately circular shape by using non-powered side roll cluster and/or horizontal rolls, (3) an edge shape-adjustment, a dimension-adjustment, a surface-finishing and a centering are performed by utilizing the so-called fin-pass rolls, and (4) at the final stage, both side-edges are welded through squeeze rolls.

The present applicant has disclosed a forming method and equipment of the strip steel by using a pipe mill and forming rolls for manufacturing welded pipes by a continuous roll-forming method (Japan Patent Laid-Open Hei 3-12975, 3-12976, 3-12977, U.S. Pat. No. 4,770,019). According to said disclosures, the roll-forming of side-edge portions and central portion of the strip steel into semi-circular forms can be achieved, without exchanging forming rolls, by employing a single roll-forming operation which enables to roll-form pipes having a wide range diameters and wall thicknesses as well. Furthermore, the bend-forming of both side-edge portions can be securely achieved. Moreover, by roll-forming the central portion of the strip steel, any shortage of edge-bending can be compensated and adjusted, and any flash on side-edge portions can be avoided, so that pipes with a wide variety of sizes and good dimension stability can be produced.

According to the aforementioned forming method, since it was an object to expand a range for the common usage of the forming-roll, the roll surface is provided with a certain shape to accommodate to a selected pipe diameter by choosing the corresponding roll surface. Namely, the forming-roll is moved to reach a position at which a desired portion of the strip steel is needed to be roll-formed. Hence, the above disclosure employed a forming-roll stand which is structured in such a manner that the forming roll is designed to set independently and freely in any one of upper or lower (vertical) direction, left or right (horizontal) direction, or the contact (rotational) direction with respect to the strip steel workpiece.

A side roll, which is employed to roll-form the central portion of the strip steel from a side-edge bending to a subsequent semicircular forming, is generally not power-driven and is set as an idler roll. When a plurality of said idler rolls is arranged sequentially and will be utilized as a cluster roll, it is preferable to set the distance between each roll as close as possible in order to prevent the opening of roll-formed side-edges due to the spring back phenomenon and to ease the sending side-edge portions to the subsequent rolls.

However, if a mechanism, which enables the contact direction of the forming-roll to sit independently and freely in both upper and lower directions as well as left and right directions in order to use the forming roll in common, is provided to each side roll stand at the cluster roll, the distance between each stand has a tendency to become larger.

Particularly, when the wall thickness to diameter ratio of the pipe is less than 1%, the adverse influence of said larger distance between each stand will become to be significant, causing a buckling of the side-edge portions and a degradation of the welding quality taking place at the subsequent process.

As a result, it is necessitated to develop a method and equipment to ease a position controlling procedure of the cluster roll in which a plurality of side rolls is subsequently placed at the roll-former. It is also required to develop a supporting method and equipment thereof for the roll-former stand by which the height and inclined angle can be arbitrarily set and the interdistance between rolls can be shortened.

When two plates are joined through the universal joints or ball-and-socket joints by using the link—being known as a linear actuator—, and in said link the length of six (6) articulated links can be changed, the position and orientation of the upper plate can be controlled by adjusting the length of said links with respect to the bed.

The aforementioned mechanism is known as a parallel mechanism, being in contrast to the serial mechanism in which an end-effector is connected to the bed through the serially connected links. Since said parallel mechanism was proposed by Stewart in 1965, it is often referred to as the "Stewart Platform" and has been applied to versatile controlling purposes ranging from a highly precise positioning control of space robots to a generally used active control of the assembly robots.

Although the flexible forming mill, which has a wide range applications proposed by the present applicant, enables to produce pipes with various diameters within a desired range without exchanging appropriate rolls, the distance between each stand will become larger when the mechanism—which enables the contact direction to set independently and freely in upper or lower direction as well as left or right direction—is provided to each of the side-roll stand. As a result, the present applicant took notice of an applicability of said parallel mechanism to the supporting method for the roll-former stand by which the height and inclined angle of rolls can be arbitrarily set and the interdistance between rolls can be reduced.

OBJECTS AND SUMMARY OF THE INVENTION

All of the foregoing have resulted in a requirement for the method and equipment of the present invention in which it is an object to provide a supporting method for the roll-former stand by which the height and inclined angle of rolls on a plurality of stands can be arbitrarily changed and set, the distance between rolls along a direction of workpiece flow can be minimized, and therefore the equipment itself can be produced in a smaller scale. The aforementioned object is achieved to a specific occasion when a plurality of identically designed stands is required, each of which is needed to move independently in upper or lower direction as well as in left or right direction, and the roll is required to rotate during the roll-forming the pipes, which is similar to the cluster portion or the fin path roll cluster in the aforementioned flexible forming mill.

It is another object of the present invention to provide an optimized supporting mechanism and connecting mechanism for a pair of platforms which might be suitable to said supporting method for the roll-former stand.

It is a further object of the present invention to provide a positioning control method for the platform which is required to control freely said connecting and supporting mechanisms for a pair of platforms which supports the roll-former stand; said mechanisms, more specifically, consists of measuring accurately the three-dimensional coordinates and 6-free axial positions of the platform, measuring method and equipment for the position of said supporting platform.

In the cluster portion as will be described in the embodiments, seven stands are needed. For each stand, three motors are required to move and rotate said stands along vertical and horizontal directions, and there are two rolls at each stand to move them in the vertical direction, hence additional five motors are necessitated, resulting in that all together 35 motors are required. However, according to the present invention, since all of roll stands of two platforms are provided, then the total required number of motors can be reduced.

Namely, when the mechanism, by which the upper or lower direction, the left or right direction as well as the contact surface direction can be set independently, is provided to each side-roll stand, the distance between each stand tends to be larger. However, according to the present invention, the platform of the roll bracket at the side rolls can be used in common, said platform is supported with a plurality of jacks, and furthermore the height and inclined angle can be freely set; therefore, the distance between rolls can be reduced.

Particularly, since the distance between rolls can be reduced, the buckling which takes place most likely at the side-edge portions can be prevented, resulting in that the productivity as well as the reliability for the subsequent welding process can be enhanced, particularly, when the wall thickness to diameter ratio of the pipe is less than 1%.

Furthermore, since the presently invented equipment is structured by the cluster platform and a plurality of jacks, the positioning control mechanism can be simplified, so that the equipment itself will become to be low cost.

DISCLOSURE OF THE INVENTION

The present inventor have found that, when a cluster roll—which is composed of a plurality of sequentially deposited forming rolls—is supported in a similar manner as the cluster roll described in the following embodiments, the positioning of the workpiece to be formed by virtue of said rolls can be controlled by the following processes; namely they include (1) providing a pair of platform on a bed at a symmetrical position with respect to a workpiece flow direction, (2) depositing a plurality of forming roll stands on each said platform, (3) employing a structure by which a pair of platforms is supported on the bed by means of a link functioning as a linear actuator such as a jack or a cylinder which is placed at a symmetrical position with respect to the workpiece flow direction, and (4) controlling the position of said pair of platforms by actions of expanding and/or contracting the link mechanism.

Moreover, the present invention possesses another advantage such that, by making the platform movable on which a plurality of forming roll stands is deposited, the workpiece flow direction can be arbitrarily selected in such a manner that it can move in upper and/or lower directions along the horizontal direction, descending and/or ascending directions in correspondence to the type of workpiece.

According to the present invention, any type of prior art structure can be employed as a link mechanism to function as a linear actuator which supports a pair of platforms, if the mentioned link can support the platform on which a plurality of forming rolls is deposited and the extent of expanding and/or contracting movement of said link can be controlled. Hence a type of said link can be appropriately chosen, corresponding to other machinery factors including the number of stands or total weight of the equipment. However, it is preferable to utilize a worm gear as will be described in the embodiments for, particularly, a structure in which a fine adjustment can be performed on the extent of the expanding and/or contracting movement, and jacks being positioned in symmetrical position can be synchronizably moved.

Furthermore, both end portions of said link which function as a linear actuator can be connected by the universal joint or spherical joint to form a continuous linkage which can form a structure in such a way that said linkage functions as a motor-driven expandable type jack or hydraulic cylinder.

The supporting equipment, according to the present invention, has a structure by which a pair of platforms—which supports a plurality of forming roll stands and is deposited at the symmetrical position with respect to the workpiece flow direction—is supported by a jack which is placed at a symmetrical position with respect to the workpiece flow direction through a spherical seat. Each platform has six jacks. Moreover, the forming roll stands have a controlling means in order to control a drive source separately which is provided for each pair of driving equipment being deposited in a symmetrical position. In the supporting equipment for said forming roll stands, a driving equipment is provided to said each jack in order to control the extent of the expanding and/or contracting movement. Furthermore, the driving equipment for said jacks, which are provided at symmetrical position with respect to the workpiece flow direction, is connected by a universal joint.

The pair of platforms, according to the present invention, is positioned at the symmetrical position with respect to the workpiece flow direction. The platform is provided on the bed on both drive and workpiece sides, and each of said platform can freely move in six (6) directions, so that any required position and orientation of the platform can be realized within a desired position for the forming line. As a result, the present invention is characterized by another distinguished advantage that the movement of said platform can be relatively controlled through the link which can also be controlled with regard to its expanding and/or contracting length.

According to the present invention, it is preferable to utilize twelve (12) links in order to support one pair of the platforms. The preferred number of links is always twelve even for a case that one pair of platform is connected with several links, and a bed and platform are connected by several links. At all events, said links can move freely in totally twelve (12) directions. Accordingly, for a case of a plurality of platform, say, n platforms are needed to develop a system which can move freely in 6×n directions; therefore all together 6×n links can be connected.

It is indispensable to change freely and precisely the position of a pair of platforms in the present invention. Furthermore, it is also necessitated to detect accurately the current position of said platforms. Accordingly, the present inventor has developed the following method to detect and measure the position of the platforms.

The position measuring method, in order to detect the position having 6 degrees of freedom in certain coordinates such as, for example, Cartesian coordinates, is characterized by measuring the length of the link connecting to each platform. The thus measured length is recorded in coordinates. An inter-changeable map with regard to relative positioning between aforementioned two coordinates should be prepared in advance. The position and orientation of the platform P is then displayed in the Cartesian coordinates through said interchangeable map by knowing the changes in the length of each link obtained by a linear encoder. The displayed data is furthermore processed by a computer to display the position by differences in the length between each link on the coordinate, resulting in that the accurate measurement of position can be achieved easily. The position of a pair of platforms can be freely and accurately changed by changing the length of each link by further comparison-computation between the information regarding the current position of each link based on the above obtained data and the information for the target position.

BRIEF DESCRIPTION OF THE DRAWINGS

The above and many other objects, features and advantages of the present invention will be more fully understood from the ensuing detailed description of the preferred embodiment of the invention, which description should be read in conjunction with the accompanying drawings.

DETAILED DESCRIPTION OF THE PREFERRED EMBODIMENT

Figure 1:
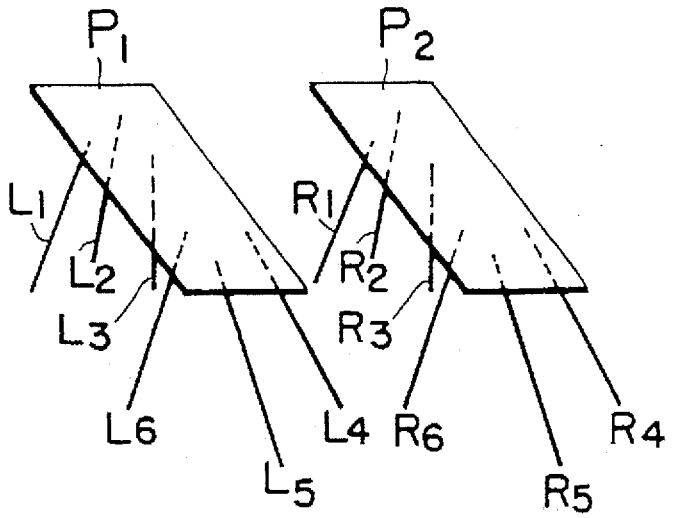
FIG. 1 is a perspective view showing a positioning of twelve links which support a pair of platforms, according to the present invention.

An example showing an arrangement of twelve links supporting a pair of platforms as seen in FIG. 1, according to the present invention, consists of a structure in such a manner that a pair of platforms $P_1$,$P_2$, which a plurality of forming roll stands (not shown) are mounted thereon and is deposited at symmetrical positions with respect to a workpiece flow direction, is supported through a spherical seat (not shown) by a group of links $R_1$~R6, $L_1$~$L_6$ which consist of six links for each said platform and arranged at symmetrical positions with respect to the workpiece flow direction.

The function of links R,L is to adjust the length of expanding and/or contracting actions in similar way as a power jack or hydraulic cylinder. Connecting points at both ends of said links are fixed on platforms or bed surfaces (not shown) in such a way that they form an arbitrary triangle. Positions of each platform $P_1$,$P_2$ can be controlled by adjusting the length of expanding and/or contracting movement of said links so that either upper or lower (vertical) direction, left or right (horizontal) direction, or contact (rotational) direction with the workpiece can be freely set along the workpiece flow direction. Namely, each platform $P_1$,$P_2$ can move freely in any one of 6 directions by adjusting the length of expanding and/or contracting movement of said links $R_1$~$R_6$, $L_1$~$L_6$ separately.

Figure 2A:
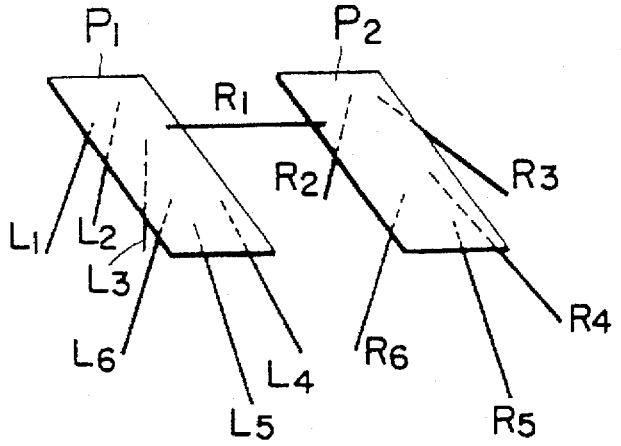
FIGS. 2A, 2B, and 2C are perspective views depicting examples of positioning of twelve links which support a pair of platforms and connect said platforms.

Let "i" be a number of links connecting the bed and the first platform $P_1$ (shown on the left side of the platforms), "j" be the number of links connecting between a pair of platforms, and "k" be the number of links connecting the bed and the second platform (shown on the right side of the figure), the feature of "i-j-k" for an example shown in FIG. 1 can be 6-0-6; while it would be 6-1-5 for a case shown in FIG. 2A.

Figure 2B:
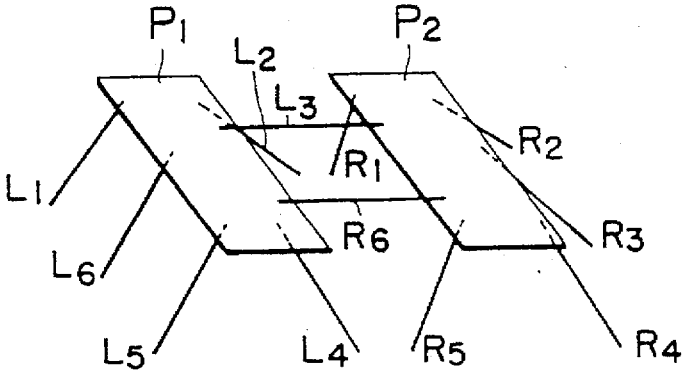
Figure 2C:
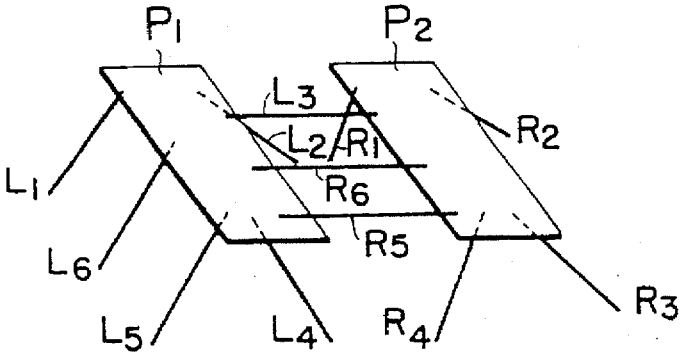
Figure 3A:
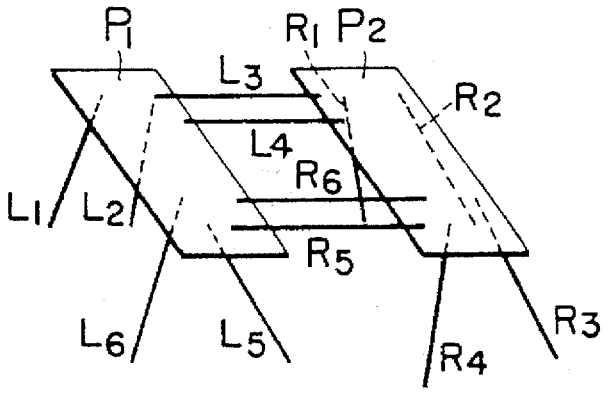
FIGS. 3A, 3B, and 3C are perspective views showing another examples of positioning of twelve links which support a pair of platforms and connect said platforms.
Figure 3B:
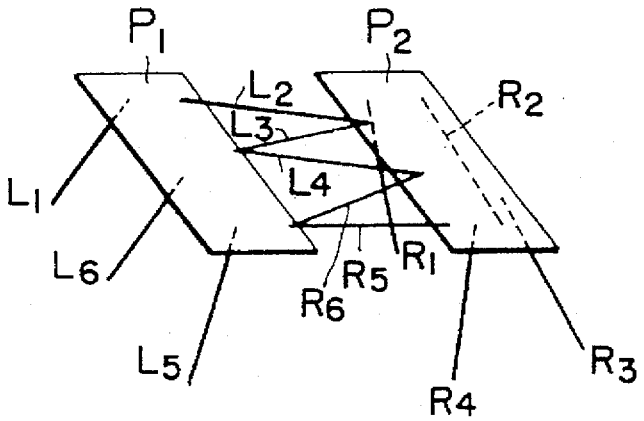
Figure 3C:
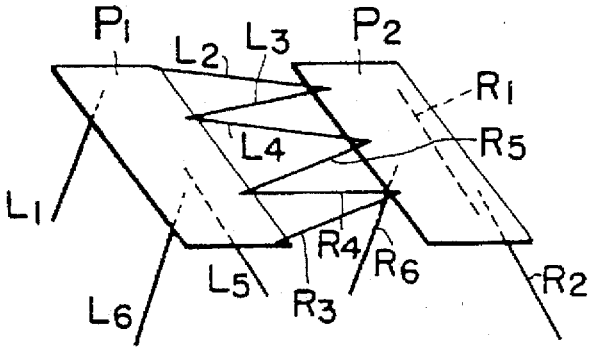

Similarly, the "i-j-k" configuration for FIG. 2B is 5-2-5, and it is 5-3-4 for the case shown in FIG. 2C. Furthermore the "i-j-k" configuration can be 4-4-4, 3-5-4, and 3-6-3 for respective FIG. 3A, 3B, and 3C. Namely, various combination of linkage configurations can be achieved by selecting number of links "j" for connecting between pair of platforms $P_1$,$P_2$, and numbers of "i" and "k" respectively connecting between the bed and platforms $P_1$,$P_2$.

Although any one of the aforementioned linkage configurations can be applicable to the present invention, the following should be taken into consideration, particularly if the linkage is employed to said flexible forming mill.

Firstly, the shape of platforms should be in a long rectangular shape in order to arrange the forming rolls to be supported as a straight line on the platforms. Moreover, a structure of the whole equipment is preferably designed to be in a symmetrical shape in order to ease the assembly and calibration. For example, it is preferable to arrange equivalent number of links for connecting between the bed and said pair of platforms.

Since the horizontal force acting on said platforms, during the roll forming process, is higher than the reaction force of the forming force acting in any directions, it is necessary to carefully design in such a way that a portion for connecting said pair of platforms on the drive side or workpiece side should be in well balance with the loading force acting on each link, particularly during the roll-forming process is carrying on. Furthermore, an appropriate selection for the connecting positions between platforms of links and the bed should be determined by analytical results on components of force acting on individual link, and said connecting positions should also be determined in such a manner that total force generated during the roll forming process can be equally and uniformly distributed on each link.

Figure 4A:
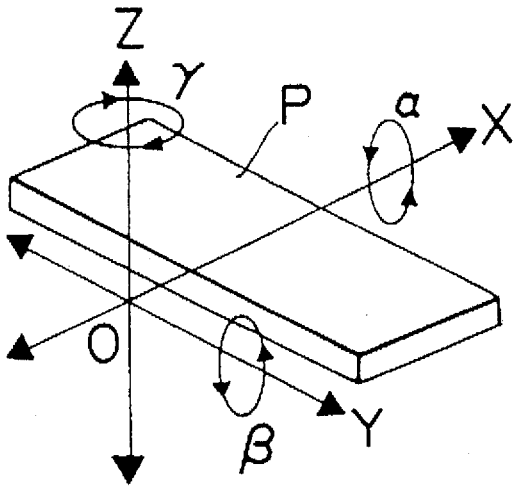
FIG. 4A is a perspective view explaining the way how 6 degrees of freedom of the platform are described and displayed on the Cartesian coordinates.

Secondly, for a purpose of describing the measuring method on positioning of the platforms according to the present invention, when an orientation relationship of the three-dimensional six degrees of freedom system for the platform P which is fixed in a certain space is required to be defined, it is normally practiced to employ the positions defined in the Cartesian coordinates (X,Y,Z) and the rotation angles ($\alpha,\beta,\gamma$) which are identified around said each Cartesian coordinate, as seen in FIG. 4A. This coordinate system is very suitable when an object, which is fixed in a certain space, is to be three-dimensionally and visually recognized and the orientation relationship of the object is to be defined.

However, in order to, for example, determine the orientation relationship of six degrees of freedom system of a pair of platforms $P_1,P_2$ in the Cartesian coordinates at a current moment when the link configuration i-j-k is 5-2-5 as seen in FIG. 2B, it is essential to measure the distance from the origin 0 (zero) to the pre-set Cartesian coordinates (X,Y,Z). Taking setting of the origin 0 (zero) and installing a sensor to the platforms into consideration, it can be anticipated that there would be several technical drawbacks associated with the aforementioned manner for determination of the positions. They may include the proper place for setting the origin 0 (zero), or the way to install numerous sensors with various designs and types.

Figure 4B:
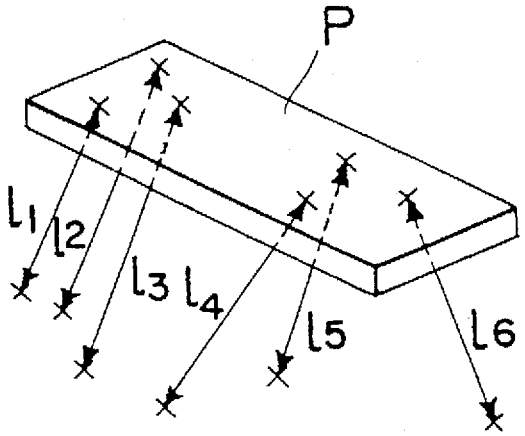
FIG. 4B is a perspective view showing 6 degrees of freedom caused by respective length of six links which are placed to said platform.

On the contrary, as seen in FIG. 4B, in order to measure the position and orientation of the platform P which is fixed in a certain space, if the required distances can be determined by the lengths ($l_1,l_2,l_3,l_4,l_5,l_6$) from arbitrarily selected six points on the platform, for example, six arbitrary points on the bed serving as reference points, it can be expected that this method would be practical by only using sensors for measuring the lengths. However, said method for measuring the distances in the coordinates is not suitable for the thought pattern of the human being, and it is extremely difficult to recognize the positions visually with excellent reproducibility.

Accordingly, the present inventor had found and developed a novel idea to determine the positions in a certain space. An interchangeable map between said two coordinates is set in the computer in advance. Information, with regard to the measured changes in lengths of links or the changes in lengths of links obtained from the sensors which enables to convert changes in extent of expanding and/or contracting movement into the changes in the total length, is input to the interchangeable map in the computer, corresponding to the signals on instantaneous extent of expanding and/or contracting movement from each link. Hence, after the computation, the position and orientation of the platform P can be displayed in the Cartesian coordinates. As a result, the current positions of six degrees of freedom of said pair of platforms $P_1,P_2$ in the Cartesian coordinates can be determined by the changes in lengths of each link.

In the present invention, the moving speed of the platforms which are needed to be controlled is relatively lower than that of the commonly used industrial robots; hence it is not required to consider the dynamic factors such as an acceleration force. The current position of the platforms can be calculated by a computer by detecting the lengths of each link.

When a user inputs a set of information with regard to desired positions as data points in Cartesian coordinates into the computer in order to let the platform to take an arbitrarily selected position, the computer then calculates the required lengths of each link at the desired positions. Then, the information on the current lengths of each link at the desired positions is comparison-computed by the computer. The differences in lengths of each link between the current positions and the target positions are next computed, so that the amount of stroke, which is required to adjust the position of the platforms to the desired position, is determined. As a result, since the required stroke for each link is defined, two different controlling methods can be achieved.

For instance, although a certain type of the hydraulic controlling mechanism can adjust the length of only one link by one control action, the lengths of each link can be changed and adjusted immediately, according to the present invention, by calculating the differences in the lengths of each link, even within the range for changing the position of the platforms by using a commonly employed method.

Moreover, by the AC-driven control system or advanced hydraulic driven system, it is possible to control the adjusting speed of the lengths of links, or to move all links simultaneously. However, each speed for each link can be computed in correspondence with the required stroke for each link, according to the present invention, so that the lengths of the links can be changed simultaneously in order to move the platforms promptly and smoothly.

It would suffice to say that it is important, from the standpoint of the highly accurate position control, to control information on the current positions and target positions by means of the feed-back or feed-forward method, when the information between the current positions and the target positions are comparison-computed and the control signals are output. This type of control system can be utilized in order to enhance the measurement accuracy.

Embodiments

One embodiment of the supporting equipment for a roll former stand, according to the present invention, will be explained in details by referring to FIGS. 5 through 8, for, particularly, a structure in which a horizontal roll is driven between the side rolls.

In order to support cluster platforms 2, on which a plurality of forming rolls is mounted, on a bed 1 serving as a base plate for the roll former by six jacks 3, both end positions of each jack are fixed on a plane surface of said cluster platform 2 to form an arbitrary triangle shape, and end surfaces of jacks are formed as a column serving as a spherical seats 4,5.

Moreover, in order for a pair of platforms 2,2 to locate at symmetrical positions with respect to the predicted direction of the workpiece flow, said jacks 3 are deposited on both left and right sides which are symmetrical with each other; each of said sides having six jacks respectively.

Furthermore, the expanding and/or contracting movement of said each jack 3 functions as a worm gear equipment. A motor 6 and a rotary encoder are connected to an input rotating axis. A driving equipment for said pair of jacks 3,3 which are deposited in a symmetrical way to each other is connected to a universal joint 7. The pair of platforms 2,2 is designed in such a manner that they are always in a symmetrical relationship to each other even after the positions are controlled and adjusted.

The position decision and driving sequences for said cluster platform 2,2 are operated by a driving each motor 6 through a computer or sequence controller which is installed separately. The driving control will also be controlled by control sequences which are set in advance.

By the controlling the symmetrical positioning of said pair of platforms, besides the mechanically synchronizing mechanism as described in the above, an electrical synchronizing mechanism can also be employed by a drive-controlling of the motors for each jack 3 while measuring the position of said electrical synchronizing mechanism with respect to the reference origin point.

A roll stand of the side roll 10 is mounted on said pair of platforms 2,2 at respective symmetrical positions. A common bed 11 is mounted on the platform 2 and a roll bracket 12 is provided to the bed. Each roll bracket 12 has a cylindrical seat to function a rotatable and controllable mechanism. Since the rotational position of each roll 10 can be individually controlled, then the equipment has a mechanism of not only the position adjustment of the platforms but also a fine adjustment thereof.

Seven (7) roll brackets 12 are deposited to each cluster platform 2 in such a manner that the horizontal roll 20,21 will be sandwiched by a pair of central side rolls 10,10. The horizontal roll 20,21 is supported by a gate-shaped stand 22 which has four (4) legs. A lower horizontal roll 21 is connected to a shaft to rotate.

In the above structured equipment for the position controlling the cluster rolls, the platform is used in common among the roll brackets 12 for side roll 10, and the degree of freedom for the position decision for the cluster platform 2 and the rotation position of each roll 10 are designed to be controllable; therefore, the side rolls 10 not only as a roll cluster but also as an individual roll can be set freely in upper or lower (vertical) direction, left or right (horizontal) direction as well as the contact (rotational) direction with the workpiece with respect to the workpiece flow direction. As a result, a common usage range of diameter of various sizes of rolls which are utilized to roll-form the central portion of the strip steel from the edge-bending to a semi-spherical shaping can be expanded. The interdistance between rolls can also be shortened.

Furthermore, even if rotatable horizontal rolls 20,21 are provided within said side roll cluster, the interdistance between side rolls is not enlarged. Hence the deterioration in the formability due to the buckling at the edge portions can be avoided.

Figure 5:
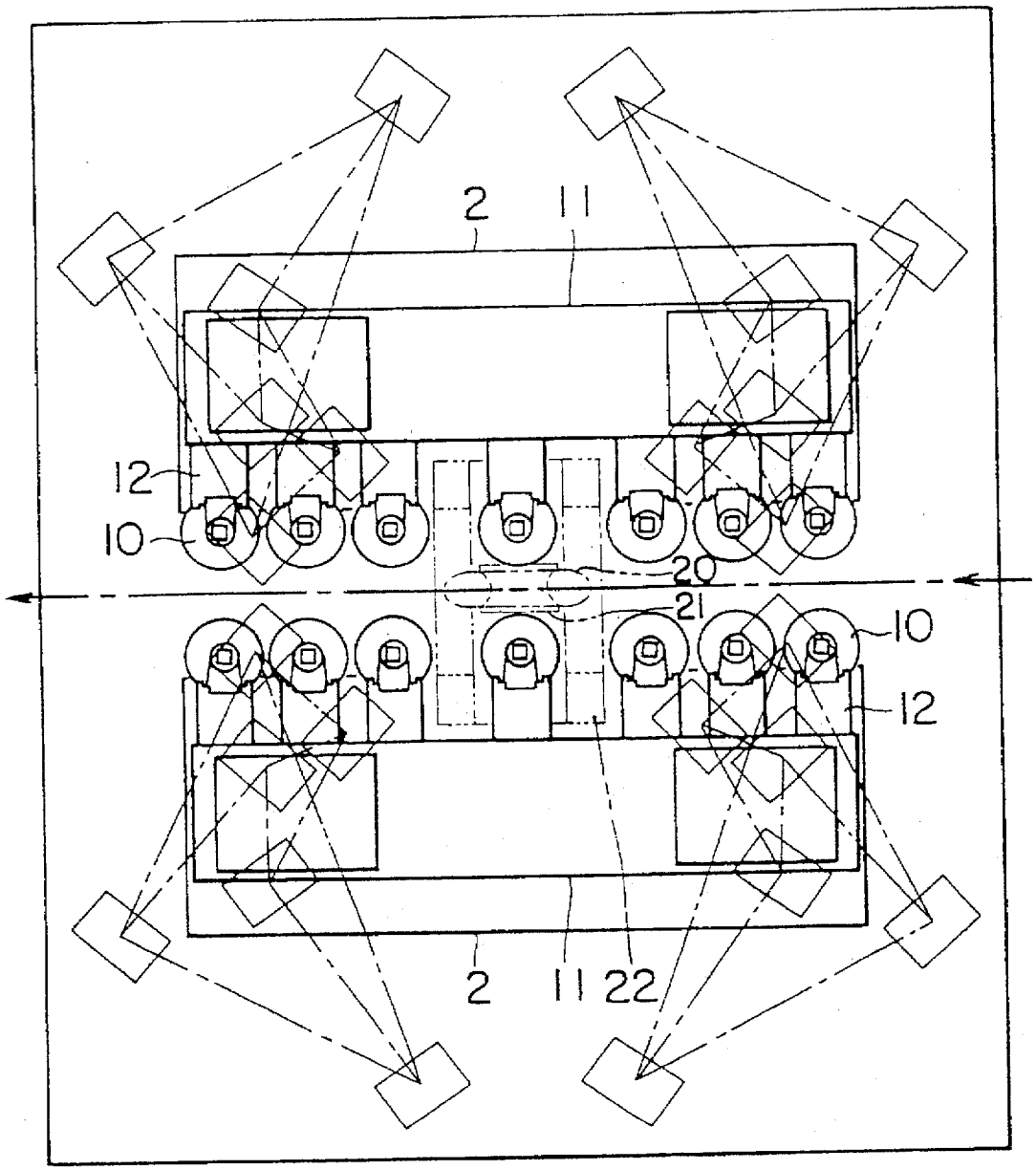
FIG. 5 is a plain view depicting rolls arranged in the supporting equipment for the forming roll stand, according to the present invention.
Figure 6:
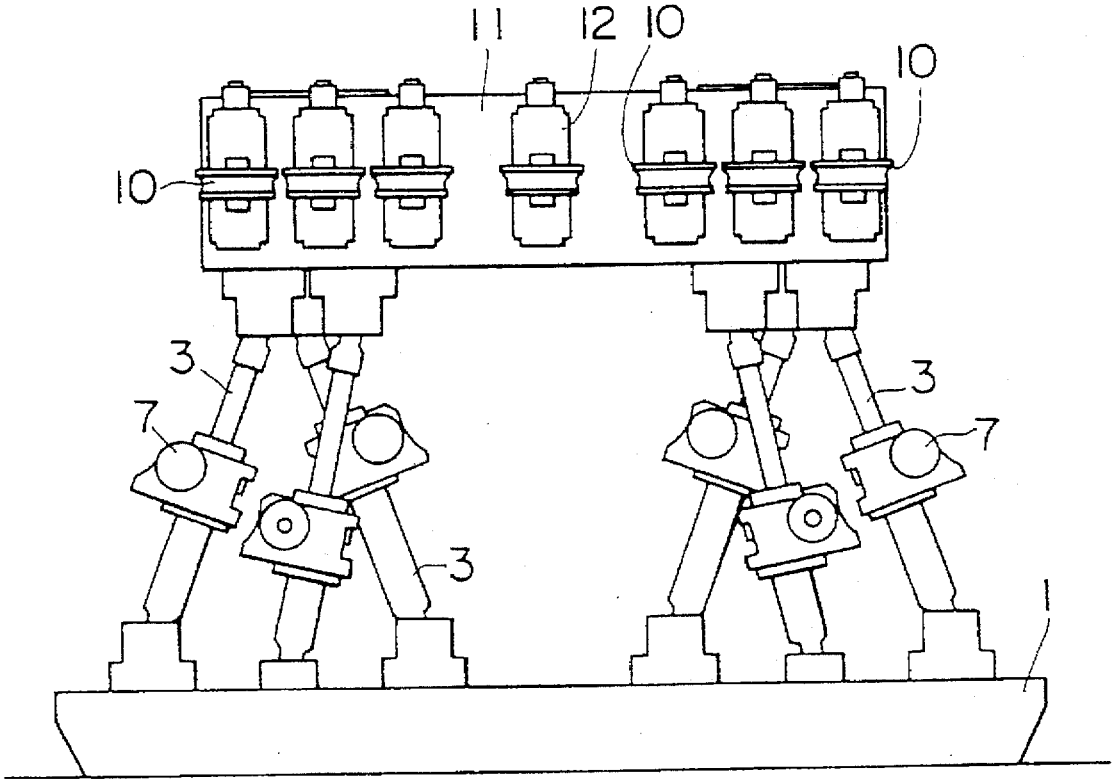
FIG. 6 is a side view showing one side cluster platform, viewing from the side-roll side.
Figure 7:
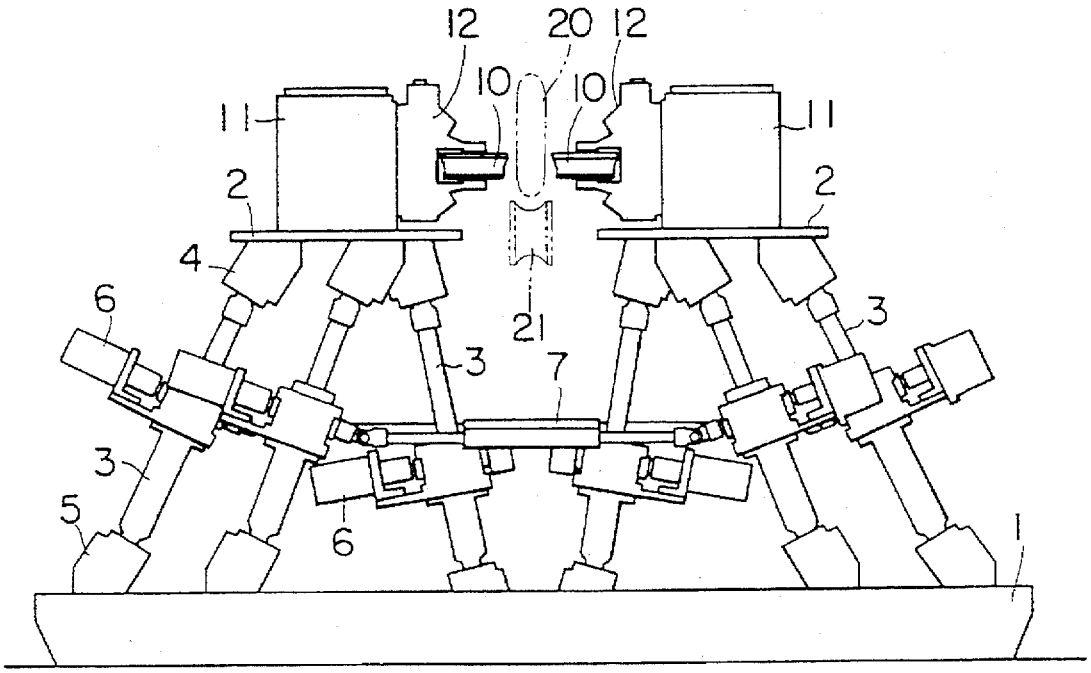
FIG. 7 is a side view depicting a supporting equipment for the forming roll stand, looking from the workpiece flow direction.
Figure 8:
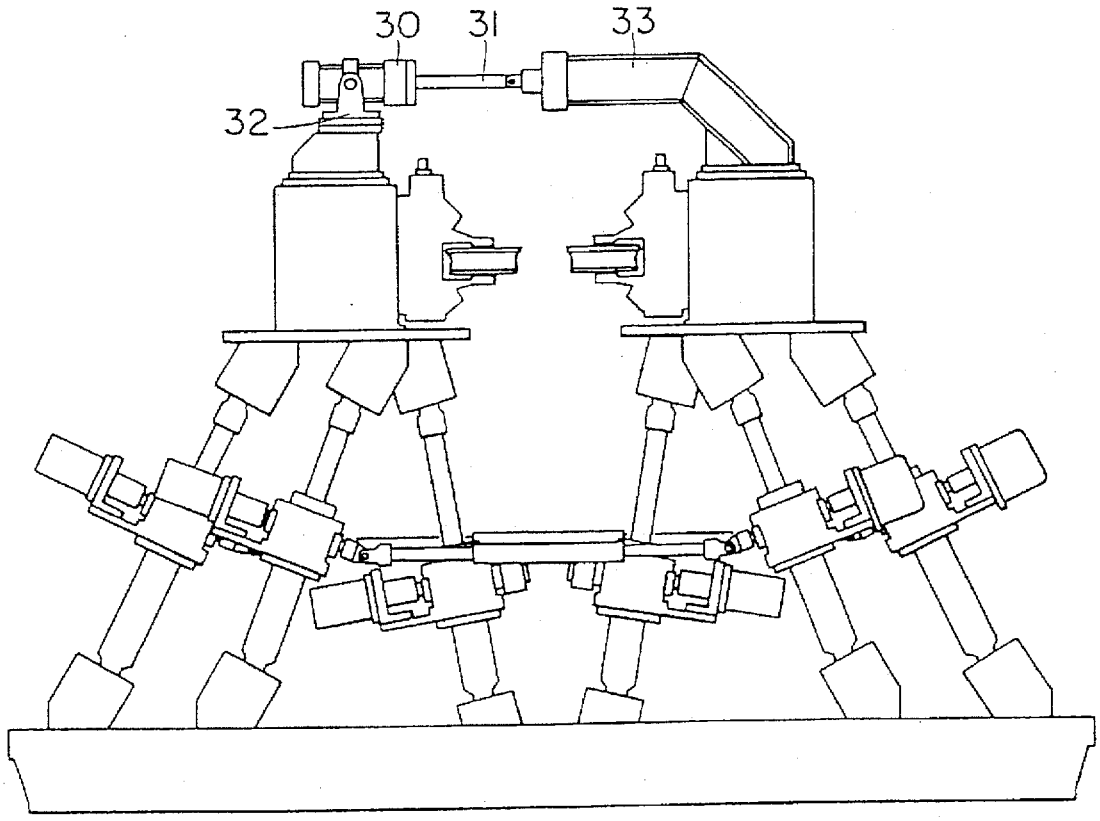
FIG. 8 is a side view showing a supporting equipment for the forming roll stand having an air cylinder, viewing from the workpiece flow direction.

In an embodiment shown in FIG. 8, instead of the roll bracket 12 which is mounted on one side cluster platform 2 seen in FIGS. 5 through 7, an air or hydraulic cylinder 30 is horizontally deposited through a supporting bed 32 on the approximately central portion of the roll bracket along the line direction. The air or hydraulic cylinder 30 is connected to the distal end of a piston rod 31, and further connected to a distal end of arm which extends along the horizontal direction of a receiving bed 33 which is provided on the roll bracket 12 being located on other side of cluster platform at a certain position.

By installing said cylinder 30 to a pre-determined direction of the roll-forming loading and applying predetermined pre-pressure to the direction of roll-forming loading, the backlash movement of said screw jack portion can be minimized. As a result, the accuracy of restorability of the cluster platform can be enhanced.

In the following, a structure and controlling method of the position controlling equipment for a pair of platforms 2,2 in the roll former stand which has the aforementioned structure will be described in details.

First, the home position of said pair of platforms 2,2 can be determined for assembly and calibration purposes. Normally, the home position is set in the horizontal direction with respect to the bed 1 in order to measure the position easily at a central portion of the work space.

The home position functions also as a reference point for the assembly as well as calibration processes. By the assembly process, the pair of platforms 2,2 will be raised up to the home position by a crane. Each jack 3 is adjusted to an accurate length in advance and fixed at an appropriate position. All jacks 3 are connected to each joints before the crane is removed. When the pair of cluster platforms is connected to the respective links, two platforms are simultaneously raised and twelve jacks and links should be placed before each platform is fixed at the predetermined positions.

The position and orientation of said pair of cluster platforms 2,2 at the aforementioned home position can be measured easily by using ordinary gauges and a ruler. The length of each jack 3 is adjusted until positions of each platform are adjusted at a desired accuracy. The experiments have demonstrated that the accuracy of ±0.5 mm was achieved. If gauges are provided, corresponding to the length of each jack 3 at the home position, the subsequent calibration (if needed) can be achieved promptly and easily.

It is not easy to measure the position and orientation of each platform 2,2 at the positions which are not home positions, particularly when the rotation angles are not 0 (zero), Namely, the computer detects only the positions of said platform 2 by the length of jacks 3 which are deposited to the rotary encoder that is connected to the computer. It is impossible for the computer to predict the degree of potential errors by knowing only the information signals with regard to the length of jacks 3 coming from the rotary encoder; said errors might be caused by the backlash of the jacks, gaps at the universal joints, or the location at which the equipment is subjected to stressing due to working load. Accordingly, in the present invention, a linear encoder is adopted in order to measure the position and orientation of each platform 2,2 with a better accuracy.

Although it is not shown in great details, linear encoders are deposited at or near by each jack 3, so that the lengths at respective points from the bed 1 to each platform 2,2 can be measured. These six linear encoders function as reference frames for a specific point on each platform 2,2. Since these reference frame points are displayed on the Cartesian coordinates, which is previously set for each platform 2,2, by the information signal on the length of each jacks 3 coming from the linear encoders, then the computer can compute, being based on the interchangeable map, and the position and orientation of the platform P are displayed on the Cartesian coordinates. Namely, the current positions of six degrees of freedom system of each platform 2,2 being displayed on the Cartesian coordinates can be determined by the changes in lengths of each jack 3.

As can be seen in the above, the linear encoder is easily installed. Moreover, potential errors involved in the data points measured by the linear encoders are much smaller than those obtained by the rotary encoder of the jack 3.

Furthermore, the location for installing the linear encoders is not limited, so that points for measurement can be freely set. As a result, the measurement on six connecting points can be reproduced by another equipment without moving the platforms, resulting in that the installation accuracy for the linear encoders and the validity of the obtained results can be evaluated.

Since the motor 6 being mounted on each jack 3, the rotary encoder and the computer which is electrically connected to said linear encoder all function together to change the contact position between the desired cluster roll and the workpiece, depending upon the various widths of the workpiece plate; then the length of each jack 3 between the bed 1 and each platform 2,2 as well as the length of jack being deposited between platforms 2,2 (if necessary) can be controlled.

Accordingly, for manufacturing the desired dimension of pipes, the computer calculates the relationship of the lengths of each jack and positions of each platform 2,2 on the Cartesian coordinates in order to compute the proper position for the rolls which are required to roll-form different sizes of workpieces and controls the position of each platform 2,2 with respect to the predicted direction of the workpiece flow.

While the invention has been explained with reference to the method and structure disclosed herein, it is not confined to the details as set forth, and this application is intended to cover modifications and changes as may come within the scope of the following claims.

What is claimed is:

1. A method for supporting a roll former stand comprising the steps of:

positioning a pair of platforms on a bed at symmetrical positions with respect to a workpiece flow direction;

mounting a plurality of forming roll stands on each said platform facing corresponding roll stands on the other platform; and arranging a plurality of expandable links between said pair of platforms and the bed such that the relative position of the platforms and the bed can be controlled by controlling the length of said expandable links.

2. A method for supporting a roll former stand as in claim 1 further comprising the step of disposing between said pair of platforms a plurality of expandable links for controlling the relative position of the platforms with one another.

3. A method for supporting a roll former stand as in claim 2, wherein the total number of links connecting the bed to each of the platforms and disposed between the platforms is twelve (12).

4. An apparatus for supporting a roll former stand comprising:

a pair of platforms on which a plurality of forming roll stands are disposed, wherein each of the platforms is positioned symmetrically with respect to a workpiece flow direction;

a plurality of expandable links connected between said platforms and a bed;

driving sources for adjusting the length of each of the expandable links; and a means for controlling each of the driving sources.

5. An apparatus for supporting a roll former stand as in claim 4, wherein a plurality of expandable links is disposed between each of the platforms for controlling the relative position of each of the platforms.

6. An apparatus for supporting a roll former stand as in claim 5, wherein the total number of expandable links connecting the platforms and the bed and expandable links disposed between each of the platforms is twelve (12).

7. An apparatus for supporting a roll former stand as in claim 4 in which a cylinder is disposed between the pair of platforms along a predicted loading direction for a roll forming process to add pre-pressure along said loading direction.

8. A method for determining the relative position of a pair of platforms in an apparatus for supporting a roll former stand, wherein the apparatus has a pair of platforms on which a plurality of forming roll stands are disposed, and wherein each of the platforms is positioned symmetrically with respect to a workpiece flow direction, and a plurality of expandable links are connected between said platforms and a bed, wherein the positioning measuring method comprises:

employing a certain coordinate to display positions of said pair of platforms;

employing a certain coordinate to display a measured length of links being connected to each said platform;

preparing an interchangeable map regarding the relative positional relationship between said two coordinates in advance;

measuring the length of each expandable link; and obtaining desired coordinates on position and orientation of said platform through the interchangeable map by knowing the measured length of each link.

9. A method for determining the relative position of a pair of platforms in an apparatus for supporting a roll former stand as in claim 6, wherein a linear encoder is employed on each link to measure the length of each link.

10. A device for determining the relative position of a pair of platforms in an apparatus for supporting a roll former stand, wherein the apparatus has a pair of platforms on which a plurality of forming roll stands are disposed, and wherein each of the platforms is positioned symmetrically with respect to a workpiece flow direction, and a plurality of expandable links are connected between said platforms and a bed, wherein the positioning measuring device comprises:

means for determining a certain coordinate to display positions of said pair of platforms;

means for displaying a measured length of links being connected to each said platform using the coordinate;

means for preparing an interchangeable map regarding the relative positional relationship between said two coordinates in advance;

means for measuring the length of each expandable link; and means for obtaining desired coordinates on position and orientation of said platform through the interchangeable map by knowing the measured length of each link.

11. A device for determining the relative position of a pair of platforms in an apparatus for supporting a roll former stand as in claim 8, wherein the means for measuring the length of each expandable link comprises a linear encoder disposed on each link to measure the length of each link.

* * * * *